US006876278B2

(12) United States Patent
Rawnick et al.

(10) Patent No.: US 6,876,278 B2
(45) Date of Patent: Apr. 5, 2005

(54) TUNABLE RESONANT CAVITY

(75) Inventors: James J. Rawnick, Palm Bay, FL (US); Stephen B. Brown, Palm Bay, FL (US)

(73) Assignee: Harris Corporation, Melbourne, FL (US)

( * ) Notice: Subject to any disclaimer, the term of this patent is extended or adjusted under 35 U.S.C. 154(b) by 0 days.

(21) Appl. No.: 10/421,352

(22) Filed: Apr. 23, 2003

(65) Prior Publication Data

US 2004/0212464 A1 Oct. 28, 2004

(51) Int. Cl.[7] ..... H01P 7/06
(52) U.S. Cl. ..... 333/231; 333/235; 333/219.1
(58) Field of Search ..... 333/231, 232, 333/235, 218, 219.1, 221, 227, 230

(56) References Cited

U.S. PATENT DOCUMENTS

| | | | | | |
|---|---|---|---|---|---|
| 4,281,280 | A | * | 7/1981 | Richards | 322/2 R |
| 4,996,188 | A | * | 2/1991 | Kommrusch | 505/210 |
| 5,008,640 | A | * | 4/1991 | Accatino et al. | 333/219.1 |
| 5,162,972 | A | | 11/1992 | Gripshover et al. | |
| 6,425,740 | B1 | * | 7/2002 | Jacobsen et al. | 417/2 |
| 6,445,267 | B1 | * | 9/2002 | Stephan | 333/232 |
| 6,508,331 | B1 | * | 1/2003 | Stuart | 181/250 |
| 6,515,235 | B2 | | 2/2003 | Moller | |
| 6,535,085 | B2 | * | 3/2003 | Song et al. | 333/219 |
| 6,600,394 | B1 | * | 7/2003 | Wang et al. | 333/235 |

OTHER PUBLICATIONS

U.S. Appl. No. 10/369,436, filed Feb. 18, 2003, Rawnick et al.
U.S. Appl. No. 10/387,208, filed Mar. 11, 2003, Rawnick et al.
U.S. Appl. No. 10/330,755, filed Dec. 27, 2002, Rawnick et al.
U.S. Appl. No. 10/330,754, filed Dec. 27, 2002, Rawnick et al.
U.S. Appl. No. 10/300,456, filed Nov. 19, 2002, Rawnick et al.
U.S. Appl. No. 10/361,548, filed Feb. 10, 2003, Rawnick et al.
U.S. Appl. No. 10/387,209, filed Mar. 11, 2003, Rawnick et al.
U.S. Appl. No. 10/439,094, filed May 15, 2003, Rawnick et al.
U.S. Appl. No. 10/387,194, filed Mar. 11, 2003, Brown et al.
U.S. Appl. No. 10/438,435, filed May 15, 2003, Brown et al.
U.S. Appl. No. 10/414,696, filed Apr. 16, 2003, Brown et al.
U.S. Appl. No. 10/637,027, filed Aug. 7, 2003, Brown et al.
U.S. Appl. No. 10/414,650, filed Apr. 16, 2003, Brown et al.

(Continued)

*Primary Examiner*—Timothy P. Callahan
*Assistant Examiner*—Hai L. Nguyen
(74) *Attorney, Agent, or Firm*—Sacco & Associates, PA

(57) ABSTRACT

A tunable resonant system (100) and a method for a varying the resonant characteristics of a resonant cavity (102). The resonant cavity (102) is enclosed by a conductive material that has at least one aperture (104) for coupling the resonant cavity (102) to an RF signal propagating in a circuit device (160). A fluidic dielectric (108) having at least one among a permittivity, a permeability and a loss tangent is at least partially disposed within the resonant cavity (102). A dielectric barrier (105) can be provided within the aperture to prevent fluid (108) from escaping the resonant cavity. A composition processor (101) is adapted for dynamically changing a composition or volume of the fluidic dielectric to vary at least one among the permittivity, the permeability and/or the loss tangent to vary, or maintain constant, a center frequency, a bandwidth, a quality factor (Q) or an impedance of the resonant cavity (102).

22 Claims, 4 Drawing Sheets

OTHER PUBLICATIONS

U.S. Appl. No. 10/635,629, filed Aug. 6, 2003, Brown et al.
U.S. Appl. No. 10/459,067, filed Jun. 11, 2003, Brown et al.
U.S. Appl. No. 10/438,436, filed May 15, 2003, Rawnick et al.
U.S. Appl. No. 10/626,090, filed Jul. 24, 2003, Brown et al.
U.S. Appl. No. 10/635,582, filed Aug. 6, 2003, Rawnick et al.
U.S. Appl. No. 10/632,632, filed Aug. 1, 2003, Rawnick et al.
U.S. Appl. No. 10/614,149, filed Jul. 7, 2003, Brown et al.
U.S. Appl. No. 10/634,219, filed Aug. 5, 2003, Rawnick et al.
U.S. Appl. No. 10/458,859, filed Jun. 11, 2003, Rawnick et al.
U.S. Appl. No. 10/624,378, filed Jul. 22, 2003, Brown et al.
U.S. Appl. No. 10/438,433, filed May 15, 2003, Rawnick et al.
U.S. Appl. No. 10/460,947, filed Jun. 13, 2003, Rawnick et al.
U.S. Appl. No. 10/409,261, filed Apr. 8, 2003, Pike.
U.S. Appl. No. 10/441,743, filed May 19, 2003, Pike.
U.S. Appl. No. 10/628,846, filed Jul. 28, 2003, Pike et al.
U.S. Appl. No. 10/448,973, filed May 30, 2003, Delgado et al.
U.S. Appl. No. 10/300,455, filed Nov. 19, 2002, Brown et al.

* cited by examiner

300

TUNABLE RESONANT CAVITY

BACKGROUND OF THE INVENTION

1. Statement of the Technical Field

The inventive arrangements relate generally to methods and apparatus for providing increased design flexibility for RF circuits and, more particularly, to resonant cavities.

2. Description of the Related Art

Resonant cavities are well known radio frequency (RF) devices and are commonly used in a variety of RF circuits, for example, in conjunction with microwave antennas and local oscillators. Resonant cavities are typically completely enclosed by conducting walls that can contain oscillating electromagnetic fields. An aperture is generally provided in one of the resonant cavity walls through which RF energy can be transmitted into, and extracted from, the resonant cavity. Resonant cavities can be constructed with a variety of shapes and can be used for different applications and frequency ranges. Nonetheless, the basic principles of operation are the same for all resonant cavities.

A resonant cavity resonates at frequencies which are determined by the dimensions of the resonant cavity. As the cavity dimensions increase, the resonant frequencies tend to decrease, and vice versa. For example, the lowest resonant frequency of a three dimensional rectangular resonant cavity is given by the equation:

$$f = \frac{C_0\sqrt{\frac{1}{a^2}+\frac{1}{b^2}}}{2\sqrt{\mu_r\varepsilon_r}}$$

where a and b the two largest dimensions of the cavity (i.e. length and width), $\in$, is the relative permittivity of the dielectric within the resonant cavity, $\mu_r$ is the relative permeability of the resonant cavity, and $C_0$ is the speed of light.

Resonant cavities provide many advantages for RF circuits operating in the microwave frequency range. In particular, resonant cavities have a very high quality factor (Q). In fact, cavities with a Q value in excess of 30,000 are not uncommon. The high Q gives resonant cavities an extremely narrow bandpass, which enables very precise operation of microwave devices utilizing the resonant cavities. In consequence to the narrow bandpass, however, resonant cavities are typically limited to operating only at very specific frequencies.

To alter the resonant frequency of a resonant cavity would typically require a mechanical manipulation of the shape and structure of the dimensions of the cavity. With rigid conventional dielectric or conductive materials, such manipulations would likely be costly and limited to certain specific structures and frequencies. Thus, a need exists for tuning a resonant cavity in a flexible and cost effective manner.

SUMMARY OF THE INVENTION

The present invention relates to a tunable resonant system, which includes a resonant cavity, and a method for a varying the resonant characteristics of the resonant cavity. The resonant cavity is enclosed by a conductive material and has at least one aperture in the conductive material for coupling the resonant cavity to an RF signal propagating in a circuit device, for example an antenna element or an oscillator. A fluidic dielectric having a permittivity, a permeability and a loss tangent can be partially disposed within the resonant cavity. A dielectric barrier can be provided within the aperture to prevent fluid from escaping the resonant cavity.

In one aspect of the present invention, at least one composition processor or a fluidic pump is adapted for dynamically changing a composition or volume of the fluidic dielectric to vary the overall permittivity, permeability and/or the loss tangent of the fluidic dielectric in the resonant cavity. In this manner at least one parameter associated with the resonant cavity can be varied or maintained. The parameter can be a center frequency, a bandwidth, a quality factor (Q) or an impedance. A controller also can be provided for controlling the composition processor in response to a control signal such as a resonant system control signal. The controller can cause the composition processor to selectively vary the permittivity and the permeability concurrently, and to selectively vary the loss tangent concurrently with the permittivity and/or the permeability by altering the volume or types of fluidic dielectric within the resonant cavity. The composition processor can include at least one conduit or feed line for selectively pumping fluidic dielectric from respective fluid reservoirs to the resonant cavity.

The fluidic dielectric used in the various cavities of a resonant cavity for example can have different characteristics, for example characteristics selected from (a) a low permittivity, low permeability, (b) a high permittivity, low permeability, and (c) a high permittivity, high permeability. Further, the high permittivity, high permeability fluidic dielectric can have a high loss tangent. The fluidic dielectric can include an industrial solvent which has a suspension of magnetic particles contained therein. The magnetic particles can be formed of ferrite, metallic salts, and organo-metallic particles. Further, the component can contain between about 50% to 90% magnetic particles by weight.

In another aspect of the present invention, a method for varying the resonant characteristics of a resonant cavity includes the step of at least partially filling the resonant cavity or one or more cavities within the resonant cavity with fluidic dielectric. The method also includes the step of changing a composition or volume of the fluidic dielectric to selectively vary at least one among a permittivity, a permeability and a loss tangent of the fluidic dielectric in response to a control signal such as a resonant system control signal. The method also can include the step of pumping the fluidic dielectric from respective fluid reservoirs to the resonant cavity (or to the cavities within the resonant cavity) to vary, or maintain constant, a center frequency, a bandwidth, a quality factor (Q) and/or an impedance associated with the resonant cavity.

DETAILED DESCRIPTION OF THE PREFERRED EMBODIMENTS

The present invention relates to a tunable resonant system. The invention provides the circuit designer with an added level of flexibility by permitting a fluidic dielectric to be used in a tuned resonant cavity (resonant cavity), thereby enabling the dielectric properties within resonant cavity to be varied. Since group velocity in a medium is inversely proportional to $\sqrt{\mu\epsilon}$, increasing the permittivity ($\epsilon$) and/or permeability ($\mu$) in the dielectric decreases group velocity of an electromagnetic field within a resonant cavity, and thus the signal wavelength. Accordingly, the permittivity and permeability of the fluidic dielectric can be selected to decrease the physical size of a resonant cavity and to tune the operational characteristics of the resonant cavity. For example, the permittivity and/or permeability can be adjusted to tune the center frequency of cavity resonances. Further, the loss tangent of the fluidic dielectric can be adjusted in addition to the permittivity and/or permeability in order to tune additional operational parameters, for instance, the quality factor (Q), bandwidth of resonances within the resonant cavity, and an impedance of the resonant cavity. Accordingly, a resonant cavity of a given size can be used for a broad range of frequencies and applications without altering the physical dimensions of the resonant cavity. Moreover, if the physical dimensions of the resonant cavity change, for example due to thermal expansion or contraction, during operation of the resonant cavity, the permittivity, permeability and/or loss tangent of the fluidic dielectric can be automatically adjusted to keep the resonant cavity tuned for optimum performance. Importantly, the present invention eliminates the need for manual adjustments, such as tuning screws, to keep the resonant cavity properly tuned.

Figure 1:
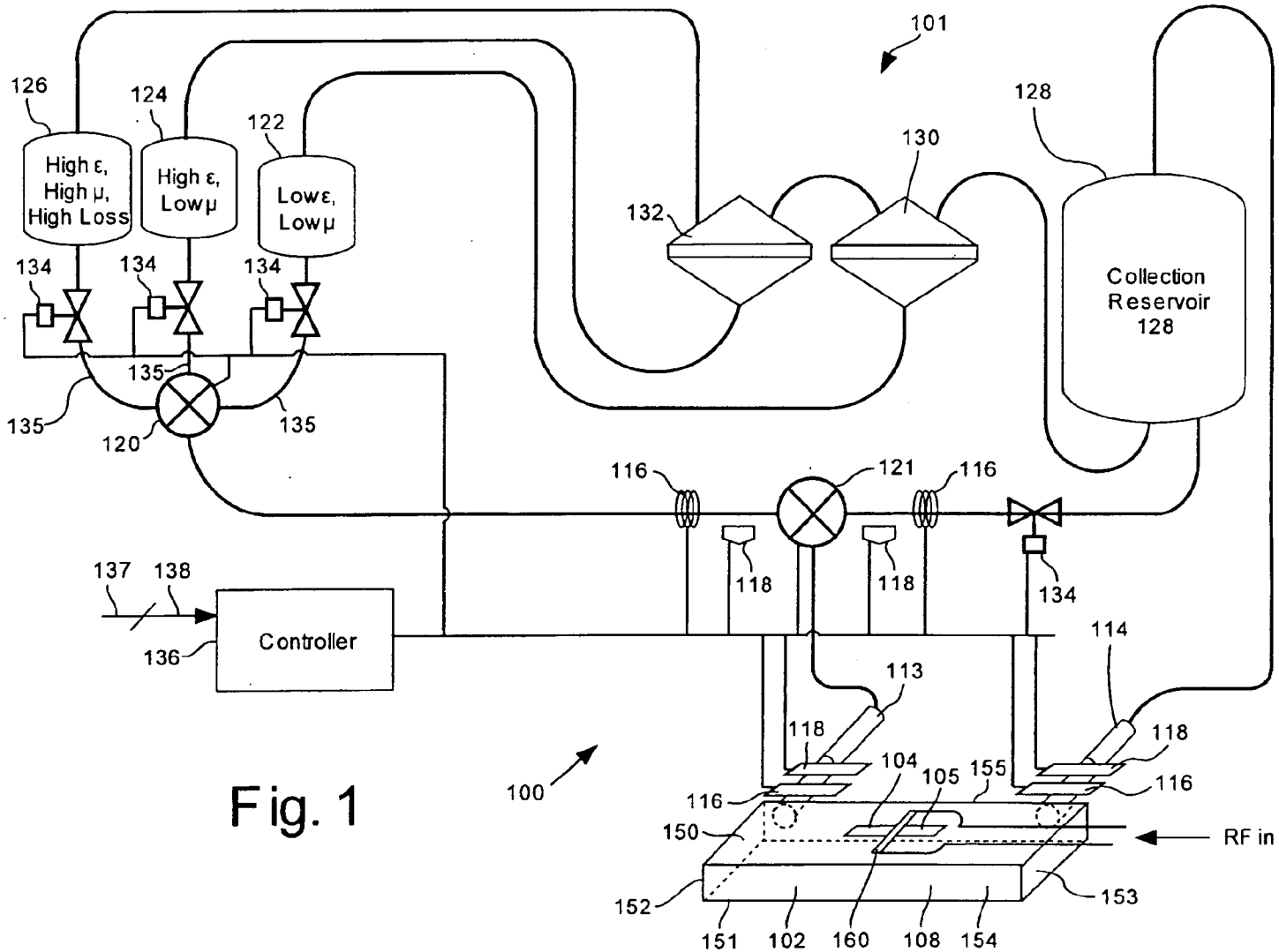
FIG. 1 is a block diagram useful for understanding the tunable resonant cavity in accordance with the present invention.

FIG. 1 is a conceptual diagram that is useful for understanding the tunable resonant cavity of the present invention. The resonant cavity apparatus 100 includes a resonant cavity 102. The resonant cavity 102 can be a cavity enclosed by an electrically or magnetically conductive material, for instance cavity walls 150, 151; 152, 153; 154, 155. The cavity walls can be fabricated from any material that can be used to construct a resonant cavity. For example, the cavity walls can be fabricated steel, brass, copper, ferrite, Invar, etc. Further, the resonant cavity can have a pre-determined geometry and can be at least partially filled with a fluidic dielectric 108. An aperture 104 can be provided in a cavity wall 150 for coupling RF signals to the resonant cavity, for example RF signals propagating in a circuit device.

Figure 2:
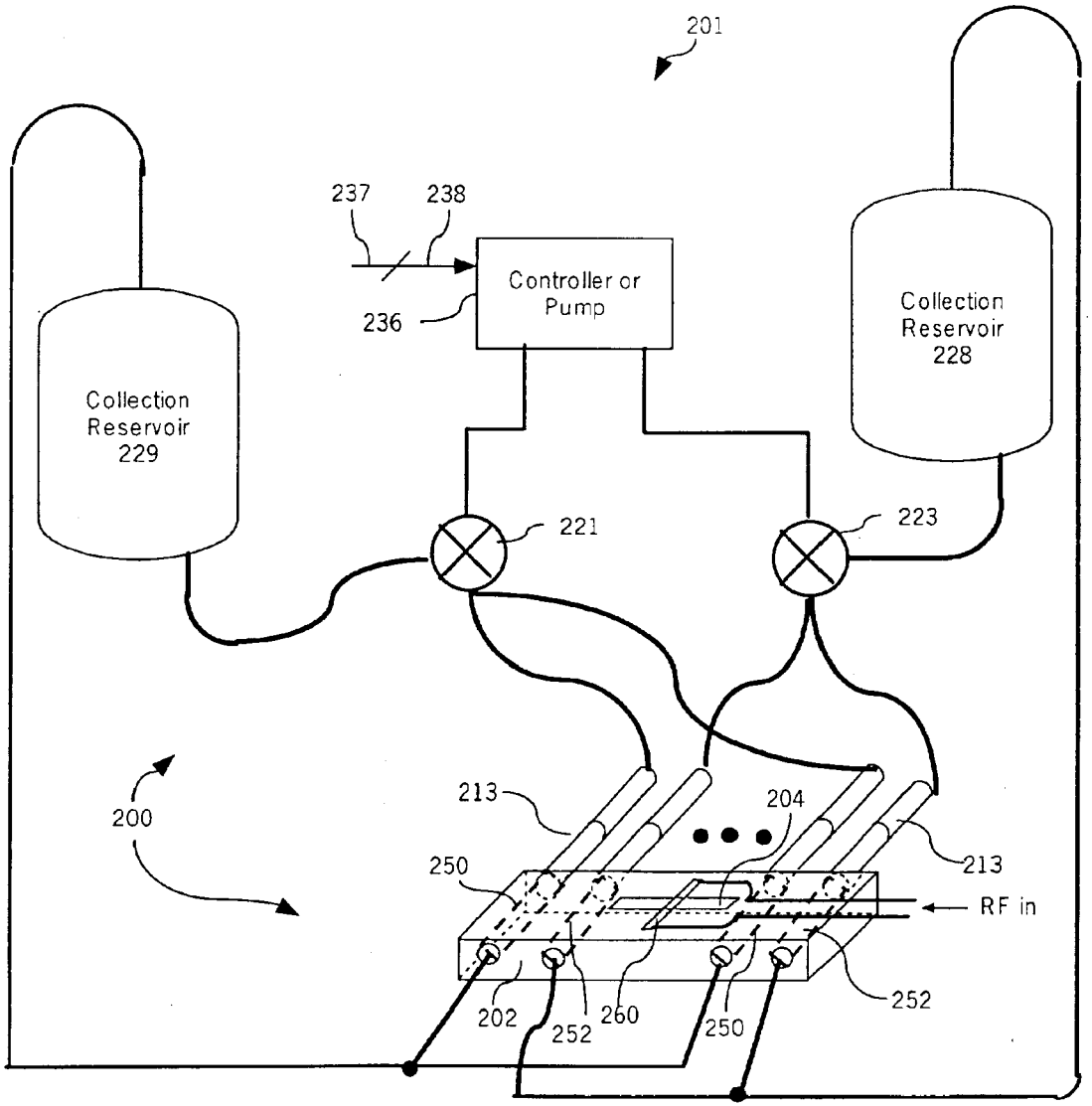
FIG. 2 is another block diagram useful for understanding another tunable resonant cavity in accordance with the present invention.
Figure 3:
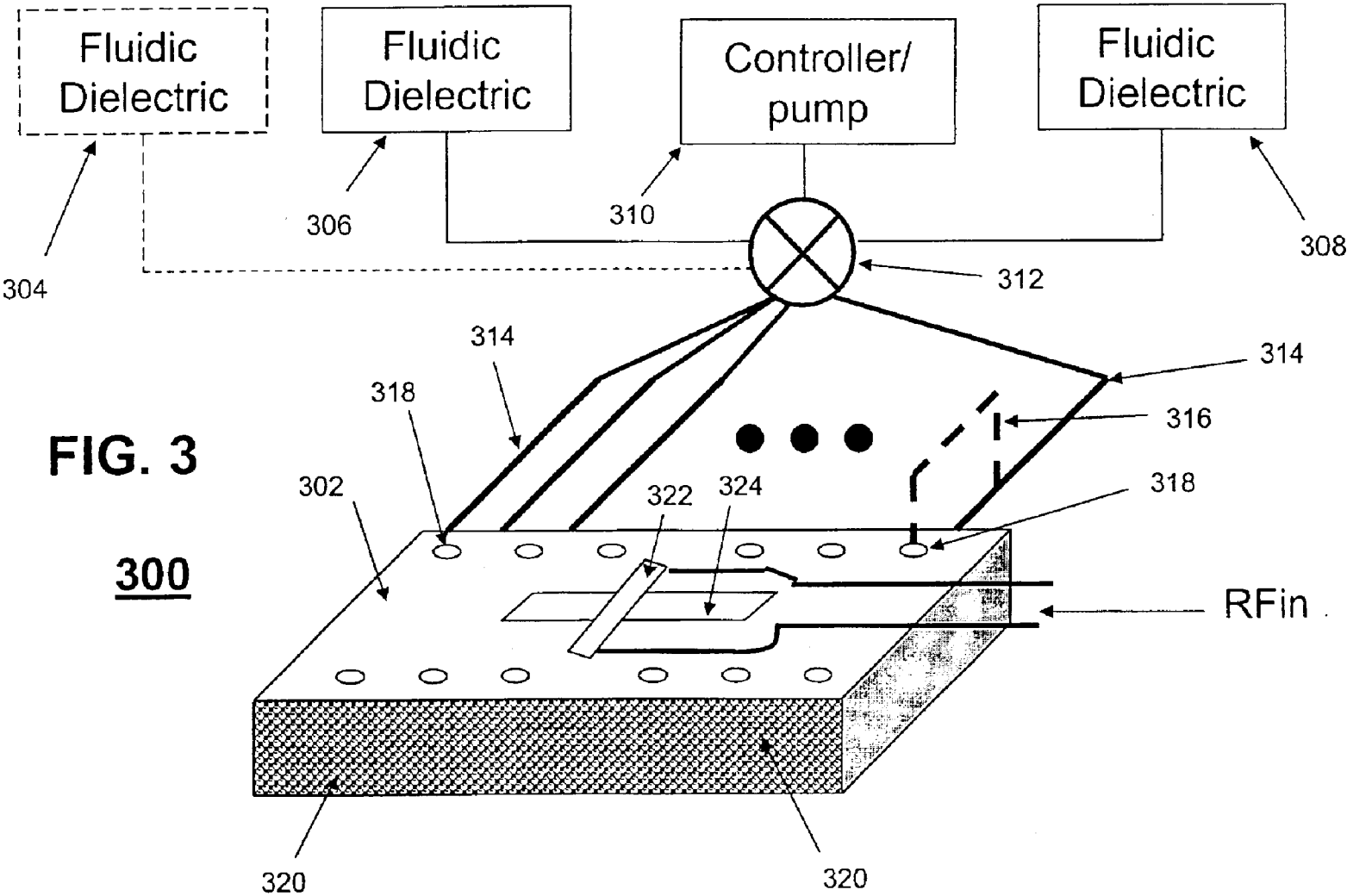
FIG. 3 is yet another block diagram useful for understanding an alternative tunable resonant cavity in accordance with the present invention.

The fluidic dielectric 108 can be constrained within the resonant cavity 102 generally or within any number of cavities such as multiple capillary tubes as will be further discussed particularly with reference to FIGS. 2 and 3. A dielectric barrier 105 can be placed in the aperture 104 to prevent leakage of the fluidic dielectric 108 from the resonant cavity 102. The dielectric barrier 105 can be glass, plastic, or any other dielectric material which is impermeable to the fluidic dielectric 108. Accordingly, the dielectric barrier 105 will maintain the fluidic dielectric 108 within the resonant cavity 102, while having an insignificant impact on resonant cavity performance.

The resonant cavity 102 can be used in any circuit that can include any other type of resonant cavity. For example, the resonant cavity 102 can be used in conjunction with an antenna element 160, as shown in FIG. 1. The resonant cavity 102 also can be used with other circuit devices, for example an oscillator or a filter. Moreover, the resonant cavity 102 can be used as a filter element. Still, there are many other applications where the resonant cavity 102 can be used, and such applications are understood to be within the scope of the present invention.

A composition processor 101 is provided for changing a composition of the fluidic dielectric 108 to vary its permittivity and/or permeability. A controller 136 controls the composition processor for selectively varying the permittivity and/or permeability of the fluidic dielectric 108 in response to a resonant system control signal 137. By selectively varying the permittivity and/or permeability of the fluidic dielectric, the controller 136 can control group velocity and phase velocity of an RF signal within the resonant cavity 102, and thus resonances within the resonant cavity 102. The permittivity and/or permeability also can be adjusted to control the impedance of the resonant cavity. By selectively varying the loss tangent of the fluidic dielectric along with the permittivity and/or permeability, the controller 136 can control the Q and bandwidth of the resonant cavity 102.

In particular, the center frequencies at which the resonant cavity 102 resonates are determined by the dimensions of the resonant cavity, for example the distance between opposing walls 150, 151; 152, 153; 154, 155. A change in permittivity and/or permeability, which results in a change in phase velocity and group velocity of a signal within a resonant cavity, effectively changes the relative dimensions of the resonant cavity with respect to signal wavelength. Accordingly, the controller 136 can control the center frequencies of the cavity resonances by adjusting the permittivity and/or permeability of the fluidic dielectric 108. For instance, the permittivity and/or permeability of the fluidic dielectric 108 can be increased to result in a lower group velocity, which will cause the center frequencies to decrease. Likewise, a decrease in permittivity and/or permeability can increase the center frequencies. Additionally, the permittivity and/or permeability also can be adjusted to tune the impedance of the resonant cavity, which is beneficial for optimizing the RF coupling between the resonant cavity 102 and a circuit element, such as the antenna element 160.

Moreover, the permittivity and/or permeability can be adjusted to maintain a resonant frequency of the resonant cavity 102 constant. For instance, the permittivity and/or permeability can be adjusted to compensate for thermal expansion and contraction of the resonant cavity, such as when a resonant cavity is exposed to temperature extremes or when a substantial amount of power loss occurs in the resonant cavity. Such power loss can occur in a resonant cavity which is used in high power microwave transmission applications.

Further, the loss tangent of the fluidic dielectric 108 can be increased to lower the Q and increase the bandwidth of a resonance of the resonant cavity 102. A decrease in the loss tangent can increase the Q and lower the bandwidth of the resonant cavity 102 resonance. The following equation is applicable: Loss tangent ($\tan\delta$)=1/Q.

Composition of Fluidic Dielectric

The fluidic dielectric can be comprised of several component parts that can be either mixed together or provided in discrete quantized volumes to produce a desired permittivity and permeability required for a particular group velocity and resonant cavity resonant frequencies. In this regard, it will be readily appreciated that fluid miscibility and particle suspension are key considerations to ensure proper mixing. Another key consideration is the relative ease by which the component parts can be subsequently separated from one another. The ability to separate the component parts is important when the operational frequency, bandwidth or Q change. Specifically, this feature ensures that the component parts can be subsequently re-mixed in a different proportion to form a new fluidic dielectric. Alternatively, desired permittivity and permeability can be achieved without necessarily mixing the components, but by providing a specific volume of particular component of fluidic dielectric. Thus, fluid miscibility, particle suspension, and separability may not be an important consideration in an embodiment that depends on discrete volumes of fluidic dielectric to alter the resonant cavity characteristics.

Many applications also require resonant cavities to be tunable over a wide frequency range. Accordingly, it may be desirable in many instances to select component mixtures or varied volumes of fluidic dielectric that produce a resonant cavity that has a relatively constant response over a broad range of frequencies. If the fluidic dielectric is not relatively constant over a broad range of frequencies, the characteristics of the fluid or their volume at various frequencies can be accounted for when the fluidic dielectric is mixed or pumped in as separate components. For example, a table of permittivity, permeability and loss tangent values vs. frequency can be stored in the controller 136 for reference during the mixing and/or pumping process.

Aside from the foregoing constraints, there are relatively few limits on the range of component parts that can be used to form the fluidic dielectric. Accordingly, those skilled in the art will recognize that the examples of component parts, mixing, pumping & extracting methods and separation methods as shall be disclosed herein are merely by way of example and are not intended to limit in any way the scope of the invention. Also, the component materials are described herein as being mixed or pumped in discretized volumes in order to produce the fluidic dielectric of a given characteristic. However, it should be noted that the invention is not so limited. Instead, it should be recognized that the composition or volume of the fluidic dielectric could be modified in other ways. For example, the component parts could be selected to chemically react with one another in such a way as to produce the fluidic dielectric with the desired values of permittivity and/or permeability. All such techniques will be understood to be included to the extent that it is stated that the composition or volume of the fluidic dielectric within the resonant cavity is changed.

A nominal value of permittivity ($\in_r$) for fluids is approximately 2.0. However, the component parts for the fluidic dielectric can include fluids with extreme values of permittivity. Consequently, a mixture of such component parts can be used to produce a wide range of intermediate permittivity values. For example, component fluids could be selected with permittivity values of approximately 2.0 and about 58 to produce a fluidic dielectric with a permittivity anywhere within that range after mixing. Dielectric particle suspensions can also be used to increase permittivity.

According to a preferred embodiment, the component parts of the fluidic dielectric can be selected to include (a) a low permittivity, low permeability, low loss component, (b) a high permittivity, low permeability, low loss component and (c) a high permittivity, high permeability, high loss component. These three components can be mixed as needed for increasing the permittivity while maintaining a relatively constant loss tangent and for increasing the loss tangent while maintaining a relatively constant product of permittivity and permeability. Still, a myriad of other component mixtures can be used. For example, the following fluidic dielectric components can be provided: (a) a low permittivity, low permeability, low loss component, (b) a high permittivity, low permeability, low loss component, (c) a high permittivity, high permeability low loss component, and (d) a low permittivity, low permeability, high loss component.

Several high loss dielectric fluids exist. Examples include the Ferrotec EMG series, specifically EMG805, EMG807 and EMG1111. Lossy fluids such as the aforementioned Ferrotec liquids would probably be a better choice since they are more likely to form a homogeneous mix as opposed to a particle suspension of Fe or Co.

High levels of magnetic permeability are commonly observed in magnetic metals such as Fe and Co. For example, solid alloys of these materials can exhibit levels of $\mu_r$ in excess of one thousand. By comparison, the permeability of fluids is nominally about 1.0 and they generally do not exhibit high levels of permeability. However, high permeability can be achieved in a fluid by introducing metal particles/elements to the fluid. For example typical magnetic fluids comprise suspensions of ferro-magnetic particles in a conventional industrial solvent such as water, toluene, mineral oil, silicone, and so on. Other types of magnetic particles include metallic salts, organo-metallic compounds, and other derivatives, although Fe and Co particles are most common. The size of the magnetic particles found in such systems is known to vary to some extent. However, particles sizes in the range of 1 nm to 20 $\mu$m are common. The composition of particles can be varied as necessary to achieve the required range of permeability in the final mixed fluidic dielectric after mixing. However, magnetic fluid compositions are typically between about 50% to 90% particles by weight. Increasing the number of particles will generally increase the permeability.

An example of a set of component parts that could be used to produce a fluidic dielectric as described herein would include oil (low permittivity, low permeability and low loss), a solvent (high permittivity, low permeability and low loss), and a magnetic fluid, such as combination of an oil and a ferrite (low permittivity, high permeability and high loss). Further, certain ferrofluids also can be used to introduce a high loss tangent into the fluidic dielectric, for example those commercially available from FerroTec Corporation of Nashua, N.H. 03060. In particular, Ferrotec part numbers EMG0805, EMG0807, and EMG1111 can be used. An example of a relatively low dielectric fluid with moderate to high loss is Lord MRF-132AD which exhibits a dielectric constant between 5 and 6 and a loss of approximately 5–6 times that of air. A hydrocarbon dielectric oil such as Vacuum Pump Oil MSDS-12602 could be used to realize a low permittivity, low permeability, and low loss tangent fluid. A low permittivity, high permeability fluid may be realized by mixing the hydrocarbon fluid with magnetic particles or metal powders which are designed for use in ferrofluids and magnetoresrictive (MR) fluids. For example magnetite magnetic particles can be used. Magnetite is also commercially available from FerroTec Corporation. An exemplary metal powder that can be used is iron-nickel, which can be provided by Lord Corporation of Cary, N.C. Fluids containing electrically conductive magnetic particles require a mix ratio low enough to ensure that no electrical path can be created in the mixture. Additional ingredients such as surfactants can be included to promote uniform dispersion of the particles. High permittivity can be achieved by incorporating solvents such as formamide, which inherently posses a relatively high permittivity. Fluid Permittivity also can be increased by adding high permittivity powders such as Barium Titanate manufactured by Ferro Corporation of Cleveland, Ohio. For broadband applications, the fluids would not have significant resonances over the frequency band of interest.

Processing of Fluidic Dielectric For Mixing/Unmixing or For Moving of Components The composition processor 101 can be comprised of a plurality of fluid reservoirs containing component parts of fluidic dielectric 108. These can include: a first fluid reservoir 122 for a low permittivity, low permeability component of the fluidic dielectric; a second fluid reservoir 124 for a high permittivity, low permeability component of the fluidic dielectric; a third fluid reservoir 126 for a high permittivity, high permeability, high loss component of the fluidic dielectric. Those skilled in the art will appreciate that other combinations of component parts may also be suitable and the invention is not intended to be limited to the specific combination of component parts described herein. For example, the third fluid reservoir 126 can contain a high permittivity, high permeability, low loss component of the fluidic dielectric and a fourth fluid reservoir can be provided to contain a component of the fluidic dielectric having a high loss tangent.

A cooperating set of proportional valves 134, mixing pumps 120, 121, and connecting conduits 135 can be provided as shown in FIG. 1 for selectively mixing and communicating the components of the fluidic dielectric 108 from the fluid reservoirs 122, 124, 126 to the resonant cavity 102. The composition processor also serves to separate out the component parts of fluidic dielectric 108 so that they can be subsequently re-used to form the fluidic dielectric with different attenuation, permittivity and/or permeability values. All of the various operating functions of the composition processor can be controlled by controller 136. The operation of the composition processor shall now be described in greater detail with reference to FIG. 1 and the flowchart shown in FIG. 4.

Figure 4:
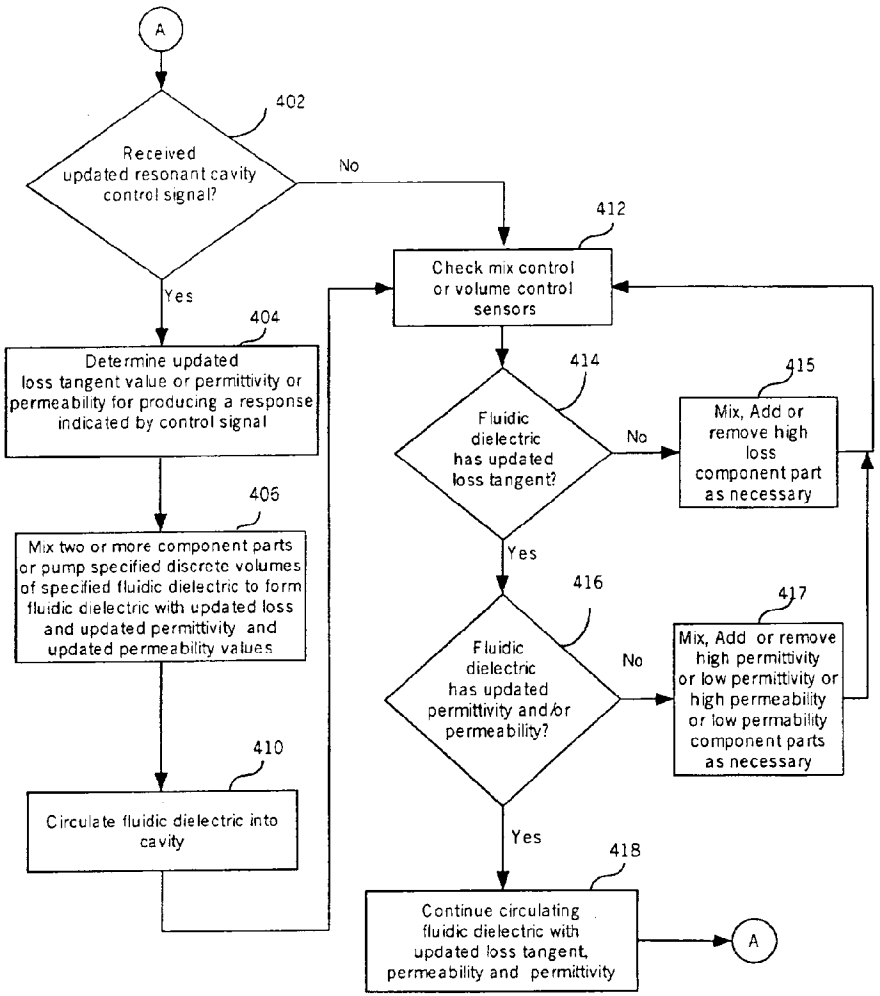
FIG. 4 is a flow chart illustrating a method in accordance with the present invention.

The process can begin in step 402 of FIG. 4, with controller 136 checking to see if an updated resonant system control signal 137 has been received on a controller input line 138. If so, then the controller 136 continues on to step 404 to determine an updated loss tangent value, an updated permittivity value, and/or an updated permeability value. The updated loss tangent value will be for producing the Q indicated by the resonant system control signal 137. The updated loss tangent value necessary for achieving the indicated attenuation can be determined using a look-up table. The controller can determine an updated permittivity value for matching the resonant frequency indicated by the resonant system control signal 137. For example, the controller 136 can determine the permeability of the fluidic components based upon the fluidic component mix ratios or discrete volume ratios of different fluidic components and determine an amount of permittivity that is necessary to achieve the indicated impedance for the determined permeability.

The controller 136 can cause the composition processor 101 to begin mixing two or more component parts in a proportion to form fluidic dielectric that has the updated loss tangent and permittivity values determined earlier. In the case that the high loss component part also provides a substantial portion of the permeability in the fluidic dielectric, the permeability will be a function of the amount of high loss component part that is required to achieve a specific attenuation. However, in the case that a separate high loss tangent fluid is provided as a high loss component part, the loss tangent can be determined independently of the permeability. This mixing process can be accomplished by any suitable means. For example, in FIG. 1 a set of proportional valves 134 and mixing pump 120 are used to mix component parts from reservoirs 122, 124, 126 appropriate to achieve the desired updated loss tangent, permittivity and permeability values.

In step 410, the controller causes the newly mixed fluidic dielectric (or discrete and separate volumes of different fluidic dielectric—see FIGS. 2 and 3) 108 to be circulated into the resonant cavity 102 through a second mixing pump 121 or through discrete cavities as shown in FIGS. 2 & 3. In step 412, the controller checks one or more sensors 116, 118 to determine if the fluidic dielectric being circulated through the resonant cavity 102 has the proper values of loss tangent, permittivity and permeability. Sensors 116 are preferably inductive type sensors capable of measuring permeability. Sensors 118 are preferably capacitive type sensors capable of measuring permittivity. Further, sensors 116 and 118 can be used in conjunction to measure loss tangent. The loss tangent is the ratio at any particular frequency between the real and imaginary parts of the impedance, and the impedance can be determined from resistance (R), conductance (G), inductance (L) and capacitance (C) measurements. Additionally, loss tangent can be easily calculated using a separate resonator device, such as a dielectric ring resonator. Such cavity resonator devices are commonly used to compute the quality factor, Q, from which loss tangent is easily extracted. The sensors can be located as shown, at the input to mixing pump 121. Sensors 116, 118 are also preferably positioned to measure the loss tangent, permittivity and permeability of the fluidic dielectric passing through input conduit 113 and output conduit 114. Note that it is desirable to have a second set of sensors 116, 118 at or near the resonant cavity 102 so that the controller can determine when the fluidic dielectric with updated loss tangent, permittivity and permeability values has completely replaced any previously used fluidic dielectric that may have been present in the resonant cavity 102.

In step 414, the controller 136 compares the measured loss tangent to the desired updated loss tangent value determined in step 404. If the fluidic dielectric does not have the proper updated loss tangent value, the controller 136 can cause additional amounts of high loss tangent component part to be added or removed to the mix (or to or from discrete cavities within the resonant cavity) from reservoir 126, as shown in step 415.

If the fluidic dielectric is determined to have the proper level of loss in step 414, then the process continues on to step 416 where the measured permittivity and permeability from step 412 is compared to the desired updated permittivity or permeability value(s) determined in step 404. If the updated permittivity or permeability value(s) has not been achieved, then high or low permittivity or permeability component parts are mixed, added or removed as necessary, as shown in step 417. The system can continue circulating the fluidic dielectric through the resonant cavity 102 until the loss tangent, permeability and/or permittivity passing into and out of the resonant cavity 102 are the proper value, as shown in step 418. Once the loss tangent, permeability, and/or permittivity are the proper value, the process can continue to step 402 to wait for the next updated resonant cavity control signal.

Significantly, when updated fluidic dielectric is required, any existing fluidic dielectric must be circulated out of the resonant cavity 102. Any existing fluidic dielectric not having the proper loss tangent and/or permittivity can be deposited in a collection reservoir 128. The fluidic dielectric deposited in the collection reservoir 128 can thereafter be re-used directly as a fourth fluid by mixing with the first, second and third fluids or separated out into its component parts so that it may be re-used at a later time to produce additional fluidic dielectric. The aforementioned approach includes a method for sensing the properties of the collected fluid mixture to allow the fluid processor to appropriately mix the desired composition, and thereby, allowing a reduced volume of separation processing to be required. For example, the component parts can be selected to include a first fluid made of a high permittivity solvent completely miscible with a second fluid made of a low permittivity oil that has a significantly different boiling point. A third fluid component can be comprised of a ferrite particle suspension in a low permittivity oil identical to the first fluid such that the first and second fluids do not form azeotropes. Given the foregoing, the following process may be used to separate the component parts.

A first stage separation process would utilize distillation system 130 to selectively remove the first fluid from the mixture by the controlled application of heat thereby evaporating the first fluid, transporting the gas phase to a physically separate condensing surface whose temperature is maintained below the boiling point of the first fluid, and collecting the liquid condensate for transfer to the first fluid reservoir. A second stage process would introduce the mixture, free of the first fluid, into a chamber 132 that includes an electromagnet that can be selectively energized to attract and hold the paramagnetic particles while allowing the pure second fluid to pass which is then diverted to the second fluid reservoir. Upon de-energizing the electromagnet, the third fluid would be recovered by allowing the previously trapped magnetic particles to combine with the fluid exiting the first stage which is then diverted to the third fluid reservoir. Those skilled in the art will recognize that the specific process used to separate the component parts from one another will depend largely upon the properties of materials that are selected and the invention. Accordingly, the invention is not intended to be limited to the particular process outlined above.

Referring to FIG. 2, a conceptual diagram useful for understanding an alternative embodiment of tunable resonant cavity is shown. The resonant cavity apparatus 200 includes a resonant cavity 202 not unlike resonant cavity 102 of FIG. 1, except that resonant cavity 202 can further include any number of discrete cavities 250 and 252 for carrying separate fluidic dielectric rather than having a single cavity 102 for receiving a mix of fluidic dielectric. The resonant cavity 202 can be a cavity enclosed by an electrically or magnetically conductive material and can be fabricated from any material that can be used to construct a resonant cavity. An aperture 204 can be provided in a cavity wall for coupling RF signals to the resonant cavity, for example RF signals propagating in a circuit device.

The different types of fluidic dielectric can be constrained within the cavities 250, 252 within the resonant cavity 102 which may be any number of capillary tubes or other cavities or chambers.

The resonant cavity 202 can be used in any circuit that can include any other type of resonant cavity. For example, the resonant cavity 202 can be used in conjunction with an antenna element 260. The resonant cavity 202 also can be used with other circuit devices, for example an oscillator or a filter. Moreover, the resonant cavity 202 can be used as a filter element. Still, there are many other applications where the resonant cavity 102 can be used, and such applications are understood to be within the scope of the present invention.

A composition processor 201 is provided for changing a composition of the fluidic dielectric to vary the overall permittivity and/or permeability within the resonant cavity 202. A controller 236 controls the composition processor for selectively varying the volume of various fluidic dielectric in response to a resonant system control signal 237. Volume control enables control of overall permittivity and/or permeability of the resonant cavity as well as control of group velocity and phase velocity of an RF signal within the resonant cavity 202, and thus resonances within the resonant cavity 202. The permittivity and/or permeability also can be adjusted to control the impedance of the resonant cavity. Volume control may also enable the ability to selectively vary the loss tangent of the fluidic dielectric along with the permittivity and/or permeability, to enable the controller 236 to control the Q and bandwidth of the resonant cavity 202.

In particular, the center frequencies at which the resonant cavity 202 resonates are determined by the dimensions of the resonant cavity, for example the distance between opposing walls. A change in permittivity and/or permeability, which results in a change in phase velocity and group velocity of a signal within a resonant cavity, effectively changes the relative dimensions of the resonant cavity with respect to signal wavelength. Accordingly, the controller 236 can control the center frequencies of the cavity resonances by adjusting the volumes of specific fluidic dielectric.

The composition processor 201 can be comprised of a plurality of fluid reservoirs containing component parts of fluidic dielectric. These can include one or more fluid reservoirs such as reservoirs 228 and 229 that can contain separate fluidic dielectric. For example one reservoir can have a low permittivity, low permeability component of the fluidic dielectric can have a high permittivity, high permeability, high loss component of the fluidic dielectric. Those skilled in the art will appreciate that other combinations of component parts may also be suitable based on a particular application and the invention is not intended to be limited to the specific combination of component parts described herein.

A cooperating set of valves and pumps 221, 223, and connecting conduits can be provided as shown in FIG. 2 for selectively adding or removing the components of the fluidic dielectric from the fluid reservoirs 228 and 229 to the discrete cavities 250, 252 within the resonant cavity 202. All of the various operating functions of the composition processor can be controlled by controller 236.

The operation of the composition processor 201 operates similar to the composition processor 101 of FIG. 1 and can generally follow the process previously described in connection with the flowchart of FIG. 4. The process can begin in step 402 of FIG. 4, with controller 236 checking to see if an updated resonant system control signal 237 has been received on a controller input line 238. If so, then the controller 236 continues on to step 404 to determine an updated loss tangent value, an updated permittivity value, and/or an updated permeability value. For example, the controller 236 can determine the permeability and/or permittivity of the resonant cavity based upon the fluidic component volume ratios in the various cavities and determine an appropriate volume for a given component using look-up tables (for know component fluidic dielectrics) to achieve a desired overall permittivity or permeability or even a loss tangent value.

In step 410, the controller causes the discrete and separate volumes of different fluidic dielectric residing in the cavities 250 and 252 to be circulated into the resonant cavity 202 through pumps 221 and 223. In step 414, the controller 236 can compare a measured loss tangent, permeability or permittivity to desired value(s) determined in step 404. If the fluidic dielectric does not have the proper updated value(s), the controller 236 can cause additional amounts of a given fluidic dielectric to be added or removed to or from the discrete cavities (250 and 252) within the resonant cavity and to and from reservoirs 228 and 229, as shown in step 415. A simple embodiment may just require a full or empty cavity, but the present invention certainly contemplates partially filled cavities to accomplished the desired results. An embodiment with many small cavities as shown in FIG. 3 would be more suitable for having a system where cavities are either empty or full.

If the fluidic dielectric is determined to have the proper level of loss in step 414, then the process continues on to step 416 where the measured permittivity and permeability from step 412 is compared to the desired updated permittivity or permeability value(s) determined in step 404. If the updated permittivity or permeability value(s) has not been achieved, then high or low permittivity or permeability component parts are added or removed as necessary, as shown in step 417. The system can continue circulating the fluidic dielectric through the resonant cavity 202 until at least one among the loss tangent, permeability and/or permittivity passing into and out of the resonant cavity 202 are the proper value, as shown in step 418. Once the loss tangent, permeability, and/or permittivity are the proper value, the process can continue to step 402 to wait for the next updated resonant cavity control signal.

Referring to FIG. 3, a resonant cavity 300 similar to resonant cavity 200 of FIG. 2 is shown. The differences between the embodiments of FIG. 2 and FIG. 3 include many more discrete cavities 320 as well as optional cavities 318 within an enclosure 302 that are formed substantially orthogonal to the cavities 320 as shown. The cavities 320 can be capillary tubes fed by a plurality of feed lines 314. The cavities 318 can have their own feed lines or tap into the feed lines as shown with the tap line 316. The enclosure can further include an aperture 324 and an antenna element 322 as shown. As in the prior embodiments, the resonant cavity 300 may further include a cooperating set of valves and pumps 312 (one shown for simplicity), controller 310 and reservoirs 304, 306, and 308. The resonant cavity 300 would operate in very much the same fashion as the resonant cavity 200 except that the many numerous cavities 320 would enable finer tuning than a system have fewer and larger cavities, particularly in a system that would use either completely filled cavities or empty cavities.

As mentioned above, the present invention can have many beneficial aspects for many applications. A resonant cavity in accordance with the present invention can be used with antennas and filters and would essentially replace systems having expensive custom machined dielectric materials since the present invention allows a designer to dynamically change dielectric load, bandwidth, cut-off frequencies, resonant frequencies and filtering characteristics over a broad operating bandwidth. The present invention could greatly benefit in the design and tuning of multi-arm spiral antennas, for example, where custom dielectric materials are difficult to produce in order to optimally match the requirements of such antennas. This is particularly true since the center area of a multi-arm antenna are designed to optimally operate on higher frequencies and the edge of the antenna may operate on lower frequencies. In other words, each area of the antenna would prefer a certain dielectric characteristic which is otherwise difficult to satisfy in absence of the present invention. The present invention is also useful for antennas that need to boost propagation properties of a signal from a particular portion of an antenna while trying to attenuate or absorb the same signal from radiating in another direction from another portion of the antenna.

While the preferred embodiments of the invention have been illustrated and described, it will be clear that the invention is not so limited. Numerous modifications, changes, variations, substitutions and equivalents will occur to those skilled in the art without departing from the spirit and scope of the present invention as described in the claims.

We claim:

1. A tunable resonant system, comprising:

a resonant cavity, said resonant cavity being enclosed by a conductive material and having at least one aperture in said conductive material for coupling said resonant cavity to an RF signal propagating in a circuit device;

at least one cavity within said resonant cavity for receiving a fluidic dielectric, said fluidic dielectric having a permittivity, a permeability and a loss tangent;

at least one composition processor adapted for dynamically changing a composition of said fluidic dielectric to vary at least one of said permittivity, said permeability and said loss tangent in said at least one cavity; and a controller for controlling said composition processor in response to a resonant system control signal.

2. The tunable resonant system according to claim 1 wherein said controller causes said composition processor to selectively vary said permittivity and said permeability in response to said resonant system control signal.

3. The tunable resonant system according to claim 1 wherein said controller causes said composition processor to selectively vary volume of fluidic dielectric in said at least one cavity.

4. The tunable resonant system according to claim 1 wherein said composition processor selectively varies at least one of said permittivity and said permeability to vary at least one parameter associated with said resonant cavity, said parameter selected from the group consisting of a center frequency, a bandwidth, a quality factor (Q) and an impedance.

5. The tunable resonant system according to claim 1 wherein said composition processor selectively varies at least one of said permittivity, said permeability and said loss tangent to maintain substantially constant at least one parameter associated with said resonant cavity, said parameter selected from the group consisting of a center frequency, a bandwidth, a quality factor (Q) and an impedance.

6. The tunable resonant system of claim 1, wherein the at least one cavity comprises a plurality of capillary tubes within the resonant cavity.

7. The tunable resonant system according to claim 1 wherein each of said at least one composition processor is independently operable for adding and removing said fluidic dielectric from each cavity of said at least one cavity.

8. The tunable resonant system according to claim 1 wherein said fluidic dielectric is comprised of an industrial solvent.

9. The tunable resonant system of claim 8, wherein the said fluidic dielectric is comprised of the industrial solvent having a suspension of magnetic particles contained therein.

10. The tunable resonant system according to claim 9 wherein said magnetic particles are formed of a material selected from the group consisting of ferrite, metallic salts, and organo-metallic particles.

11. The tunable resonant system according to claim 9 wherein said fluidic dielectric contains between about 50% to 90% magnetic particles by weight.

12. A resonant cavity, comprising:

a metalized enclosure having a plurality cavities, wherein the plurality of cavities are designed for receiving at least one fluidic dielectric having a permittivity and a permeability;

at least one fluidic pump unit for moving said at least one fluidic dielectric among at least one of said plurality of cavities and a reservoir for adding and removing said fluid dielectric to said at least one of said plurality of cavities in response to a control signal.

13. The resonant cavity according to claim 12 further comprising a dielectric barrier within an aperture in the metalized enclosure, said dielectric barrier preventing fluid from escaping said resonant cavity through said aperture.

14. The resonant cavity according to claim 12, wherein the resonant cavity further comprises at least one aperture in said metalized enclosure for coupling said resonant cavity to an RF signal propagating in a circuit device.

15. The resonant cavity according to claim 14 wherein said circuit device is selected from a group comprising an oscillator and antenna element.

16. A method for discretely varying the resonant characteristics of a resonant cavity comprising the steps of:

at least partially filling the resonant cavity with a fluidic dielectric; and dynamically changing a volume of said fluidic dielectric to selectively vary at least one of a permittivity, a permeability and a loss tangent of said resonant cavity in response to a resonant system control signal.

17. The method of claim 16, wherein the step of at least partially filling comprises the step of at least partially filling a plurality of discrete cavities within the resonant cavity with the fluidic dielectric.

18. The method according to claim 16, wherein the step of partially filling comprises the step of filling with fluidic dielectric having characteristics selected from the group consisting of (a) a low permittivity, low permeability component, (b) a high permittivity, low permeability component, and (c) a high permittivity, high permeability component.

19. The method according to claim 16 further comprising the step of selectively varying said permittivity and said permeability concurrently in response to said resonant system control signal.

20. The method according to claim 16 further comprising the step of selectively varying said loss tangent and at least one of said permittivity and said permeability concurrently in response to said resonant system control signal.

21. The method according to claim 16 further comprising the step of selectively varying at least one of said permittivity, said permeability and said loss tangent to vary at least one parameter associated with the resonant cavity, said parameter selected from the group consisting of a center frequency, a bandwidth, a quality factor (Q) and an impedance.

22. The method according to claim 16, further comprising the step of selectively adding and removing a fluidic dielectric from selected ones of a plurality of said cavities of the resonant cavity in response to a control signal.

* * * * *